US010550613B2

(12) United States Patent
Jean

(10) Patent No.: US 10,550,613 B2
(45) Date of Patent: Feb. 4, 2020

(54) PRESSING TYPE LATCH DEVICE

(71) Applicant: KHAN'S ENTERPRISE CO., LTD., Taoyuan (TW)

(72) Inventor: Wen-Fong Jean, Taoyuan (TW)

(73) Assignee: Khan's Enterprise Co., Ltd., Taoyuan (TW)

( * ) Notice: Subject to any disclaimer, the term of this patent is extended or adjusted under 35 U.S.C. 154(b) by 445 days.

(21) Appl. No.: 15/428,405

(22) Filed: Feb. 9, 2017

(65) Prior Publication Data

US 2018/0223571 A1 Aug. 9, 2018

(51) Int. Cl.

| | |
|---|---|
| ***E05C 5/02*** | (2006.01) |
| ***E05B 5/02*** | (2006.01) |
| ***E05B 13/00*** | (2006.01) |
| ***E05B 17/00*** | (2006.01) |
| ***E05B 65/00*** | (2006.01) |

(52) U.S. Cl.

CPC ..... *E05C 5/02* (2013.01); *E05B 5/003* (2013.01); *E05B 13/002* (2013.01); *E05B 17/0025* (2013.01); *E05B 65/006* (2013.01); *Y10T 292/089* (2015.04); *Y10T 292/0886* (2015.04); *Y10T 292/0887* (2015.04); *Y10T 292/0889* (2015.04); *Y10T 292/0893* (2015.04); *Y10T 292/0932* (2015.04); *Y10T 292/0949* (2015.04); *Y10T 292/108* (2015.04); *Y10T 292/57* (2015.04)

(58) Field of Classification Search

CPC ..... Y10T 292/089; Y10T 292/0949; Y10T 292/0893; Y10T 292/0932; Y10T 292/108; Y10T 292/57; Y10T 292/0886; Y10T 292/0887; Y10T 292/088; E05C 5/02; E05C 3/042; E05B 5/003; E05B 13/002; E05B 17/0025; E05B 65/006

USPC .... 292/DIG. 31, DIG. 60, DIG. 61, DIG. 63; 70/208, 201, 210, 224, 432

See application file for complete search history.

(56) References Cited

U.S. PATENT DOCUMENTS 2,772,809 A * 12/1956 Ross ..... B60K 15/0406 220/318
3,089,330 A * 5/1963 Kerr ..... E05B 5/003 292/251
4,370,874 A * 2/1983 Munn ..... E05B 5/00 292/204

(Continued)

FOREIGN PATENT DOCUMENTS

EP 2963208 A1 1/2016

*Primary Examiner* — Kristina R Fulton
*Assistant Examiner* — Faria F Ahmad
(74) *Attorney, Agent, or Firm* — Alan D. Kamrath; Karin L. Williams; Mayer & Williams PC

(57) ABSTRACT

A pressing type latch device includes a seat, a pivotal seat mounted in the seat, and a handle having a grasping portion pivotably connected to two eccentric locations of the pivotal seat, such that a greater operational height can be formed when the handle is lifted. When the latch device is in one of a plurality of retainable open positions or a retainable closed position, the grasping portion of the handle can be moved to a position to lift the pivotal seat, such that the grasping portion of the handle lies flush with the pivotal seat. On the other hand, when the grasping portion of the handle is lifted to move the pivotal seat downward, the handle and the pivotal seat can rotate freely. Since the latch device includes a closed position and a plurality of open positions, the latch device can be installed and used more easily.

7 Claims, 11 Drawing Sheets

(56) References Cited

U.S. PATENT DOCUMENTS 4,377,243 A * 3/1983 Shaw ..... B60K 15/0409 220/210
4,706,478 A * 11/1987 Swan ..... E05B 5/00 292/336.3
4,763,935 A * 8/1988 Bisbing ..... E05B 17/0025 292/66
5,076,080 A * 12/1991 Fuss ..... E05C 3/042 292/66
5,127,686 A * 7/1992 Gleason ..... E05B 5/00 292/216
5,409,272 A * 4/1995 McCormack ..... E05B 5/00 292/229
5,820,174 A * 10/1998 Parikh ..... E05B 5/00 292/126
5,904,385 A * 5/1999 Linder ..... E05B 17/185 292/336.3
5,913,908 A * 6/1999 Czipri ..... E05B 13/004 292/336.3
5,984,383 A * 11/1999 Parikh ..... E05B 1/0092 292/121
6,418,761 B1 * 7/2002 Wytcherley ..... E05B 13/004 292/210
6,502,871 B1 * 1/2003 Malmanger ..... E05C 3/042 292/163
6,516,643 B1 * 2/2003 Olshausen ..... E05B 27/0053 70/337
6,530,250 B1 * 3/2003 Linares ..... E05B 13/004 292/207
6,578,884 B2 * 6/2003 Chiang ..... E05B 1/0092 292/200
6,626,472 B1 * 9/2003 Berg ..... E05B 13/002 292/336.3
6,722,716 B2 * 4/2004 Baser ..... E05B 3/003 292/336.3
D489,958 S * 5/2004 Jackson ..... D8/331
D489,959 S * 5/2004 Jackson ..... D8/331
6,952,940 B2 * 10/2005 Molzer ..... E05B 1/0092 70/208
6,953,209 B2 * 10/2005 Jackson, Jr. ..... E05B 17/0025 16/412
6,976,375 B2 * 12/2005 Minix ..... E05B 1/0092 292/194
7,066,504 B2 * 6/2006 Perkins ..... E05C 1/145 292/160
7,313,937 B2 * 1/2008 Straka, Jr. ..... E05B 13/10 292/336.3
7,398,664 B1 * 7/2008 Weinerman ..... E05B 1/0092 292/207
7,452,010 B2 11/2008 Cotton
7,454,933 B1 * 11/2008 Paige ..... E05B 1/0092 292/207
7,611,173 B2 * 11/2009 Helton ..... E05B 13/002 292/137
7,634,930 B2 * 12/2009 Boesel ..... E05B 29/00 70/383
7,752,877 B2 * 7/2010 Burns ..... E05B 5/00 292/336.3
7,921,685 B2 * 4/2011 Teskey ..... E05B 5/00 292/126
8,016,329 B2 * 9/2011 Johansson ..... E05B 13/002 292/108
8,136,850 B2 * 3/2012 Wollacott ..... E05C 3/162 292/173
8,272,240 B1 * 9/2012 Schilens ..... E05B 1/0092 292/336.3
8,516,862 B2 * 8/2013 Stuckey ..... E05B 47/0603 292/336.3
8,915,105 B2 * 12/2014 Weinerman ..... E05C 3/041 292/207
9,016,735 B2 * 4/2015 Lesueur ..... E05B 77/06 292/336.3
9,593,514 B2 * 3/2017 Patel ..... E05B 83/36
D789,771 S * 6/2017 Tung ..... D8/331
9,957,732 B1 * 5/2018 Tomao ..... E05B 13/10
2004/0056488 A1 * 3/2004 Jackson, Jr. ..... E05B 17/0025 292/66
2004/0183312 A1 * 9/2004 Magnusson ..... B63B 19/24 292/95
2005/0144993 A1 * 7/2005 Antonucci ..... E05B 9/086 70/208
2009/0256368 A1 10/2009 Le et al.
2014/0331722 A1 * 11/2014 Bridgewater ..... E05O 5/02 70/57

* cited by examiner

PRESSING TYPE LATCH DEVICE

BACKGROUND OF THE INVENTION

The present invention relates to a pressing type latch device and, more particularly, to a pressing type latch device that can be set to include a plurality of retainable open positions and a retainable closed position.

To achieve a tight closing effect of a door or a boat hatch, a D-handle latch for boat hatches has been proposed. U.S. Pat. No. 7,452,010 discloses a handle for moving a pull shaft between an upper position and a lower position in the vertical direction. When the pull shaft is in the lower position, a latch bar can engage the hatch jamb in a latched position. The shape of the handle matches with a well of a housing to precisely move the latch bar to the latched position, such that the handle can be inserted into the well only after 180° rotation to achieve a closing state or an open state. Furthermore, a pin of the pull shaft must be located in a slot of a boss of the housing, such that the handle can only actuate the latch bar in a fixed direction for closing or opening purposes.

Closing and opening of the above D-handle latch must be operated in a specific direction, and the handle can be inserted into the well only after 180° rotation. Thus, the installer must notice the operating direction during installation, which is inconvenient. Furthermore, if a user applies the force in the wrong direction, the boat latch cannot be opened, and the latch could even be damaged.

BRIEF SUMMARY OF THE INVENTION

The primary objective of the present invention is to provide a latch device including a handle pivotably connected to two eccentric locations of a body of a disc, such that a greater operational height can be formed when the handle is lifted. Furthermore, the latch device can be set to include a plurality of retainable open positions and a retainable closed position. Thus, the latch device can be installed and used more easily.

The secondary objective of the present invention is to use an engaging member of a disc of the latch device to secure the handle in a state preventing burglars or preventing mistaken opening, such that the handle cannot be lifted and rotated.

To fulfill the above objectives, the present invention provides a pressing type latch device including a seat, a disc, and a handle. The seat includes a base. A peripheral wall extends upward from a periphery of the base. A receiving space is defined between the base and the peripheral wall. A restraining portion extends downward from a central portion of a bottom face of the base and has a central hole intercommunicated with the receiving space.

The disc includes a body received in the receiving space of the seat. The disc further includes an actuating portion extending downward from the body along a longitudinal axis and rotatably extending through the central hole. The actuating portion is rotatable about the longitudinal axis within a rotational range. The actuating portion is movable along the longitudinal axis. The actuating portion in the rotational range includes a first position corresponding to a retainable closed position of the latch device and a second position corresponding to a retainable open position of the latch device. The disc further includes a connecting portion extending downward from the actuating portion. A pressing plate is mounted to the connecting portion.

The handle includes a grasping portion having two pivotal portions at two ends thereof. The grasping portion is arcuate. The two pivotal portions are respectively and pivotably connected to two eccentric locations of two sides of the body of the disc, such that a peripheral length of an outer edge of the grasping portion is larger than one half of a circumference of the receiving space. When the actuating portion of the disc is in the first position or the second position, the grasping portion of the handle is permitted to be received in the receiving space and to lie flush with the body, and the grasping portion is permitted to be lifted to a lifted position relative to the body and to rotate the disc via the two pivotal portions.

In an example, the receiving space of the seat is circular in cross section. The restraining portion includes a bottom end having two first restraining grooves opposite to each other and two second restraining grooves opposite to each other. A positioning pin is mounted to the actuating portion of the disc and is located on the bottom end of the restraining portion of the seat. An elastic element is mounted around the actuating portion and has two ends respectively abutting a stopper ring in the central hole and the positioning pin. The grasping portion is a portion of a circle in cross section and is shaped corresponding to the receiving space. Each of the two pivotal portions includes a side having a braking face and a release face. A spacing between the braking face of each of the two pivotal portions and a pivotal connection between the pivotal portion and the body is larger than a spacing between the release face and the pivotal connection between the pivotal portion and the body.

When the grasping portion lies flush with the body, the braking face abuts against a surface of the base of the seat such that the two pivotal portions support the body in a position above the base, the positioning pin is located in the two first restraining grooves or the two second restraining grooves, and the actuating portion are retainable in third and fourth positions within the rotational range of the actuating portion. Each of the third and fourth positions corresponds to a retainable open position of the latch device.

When the grasping portion is lifted to the position perpendicular to the body, the release face of each of the two pivotal portions abuts against the surface of the base to make the body adjacent to the base, and the positioning pin is moved out of the two first restraining grooves or the two second restraining grooves.

In an example, the body of the disc includes a limiting groove in an outer side thereof. An elastic member and a positioning member are received in the limiting groove. The positioning member is partially exposed outside of the limiting groove. The seat includes an inner wall face facing the receiving space and having four engaging grooves. The four engaging grooves are spaced from each other by an angle equal to an angle between each of the two first restraining grooves and one of the two second restraining grooves. The positioning member is biased by the elastic member to be engaged in one of the four engaging grooves.

In an example, the body of the disc includes a surface having a receiving groove. A lock is mounted in the receiving groove and includes an engaging member at a lower end thereof. The engaging member is located between a bottom of the body and the base. The engaging member moves perpendicularly to the longitudinal axis when the lock rotates. At least one of the two pivotal portions of the handle includes a fixing groove. The fixing groove faces the engaging member when the grasping portion lies flush with the body.

In an example, a fixing nut is located below the pressing plate and is threadedly engaged with the connecting portion of the disc. The fixing nut includes two operative ends respectively extending outward from two sides thereof.

In an example, a distal end of the peripheral wall of the seat is bent to form an abutment portion, and the abutment portion has a first mark. The body of the disc includes a surface having a second mark. The latch device is in a positioned state indicated by the second mark when in alignment with the first mark.

The present invention will become clearer in light of the following detailed description of illustrative embodiments of this invention described in connection with the drawings.

DETAILED DESCRIPTION OF THE INVENTION

Figure 1:
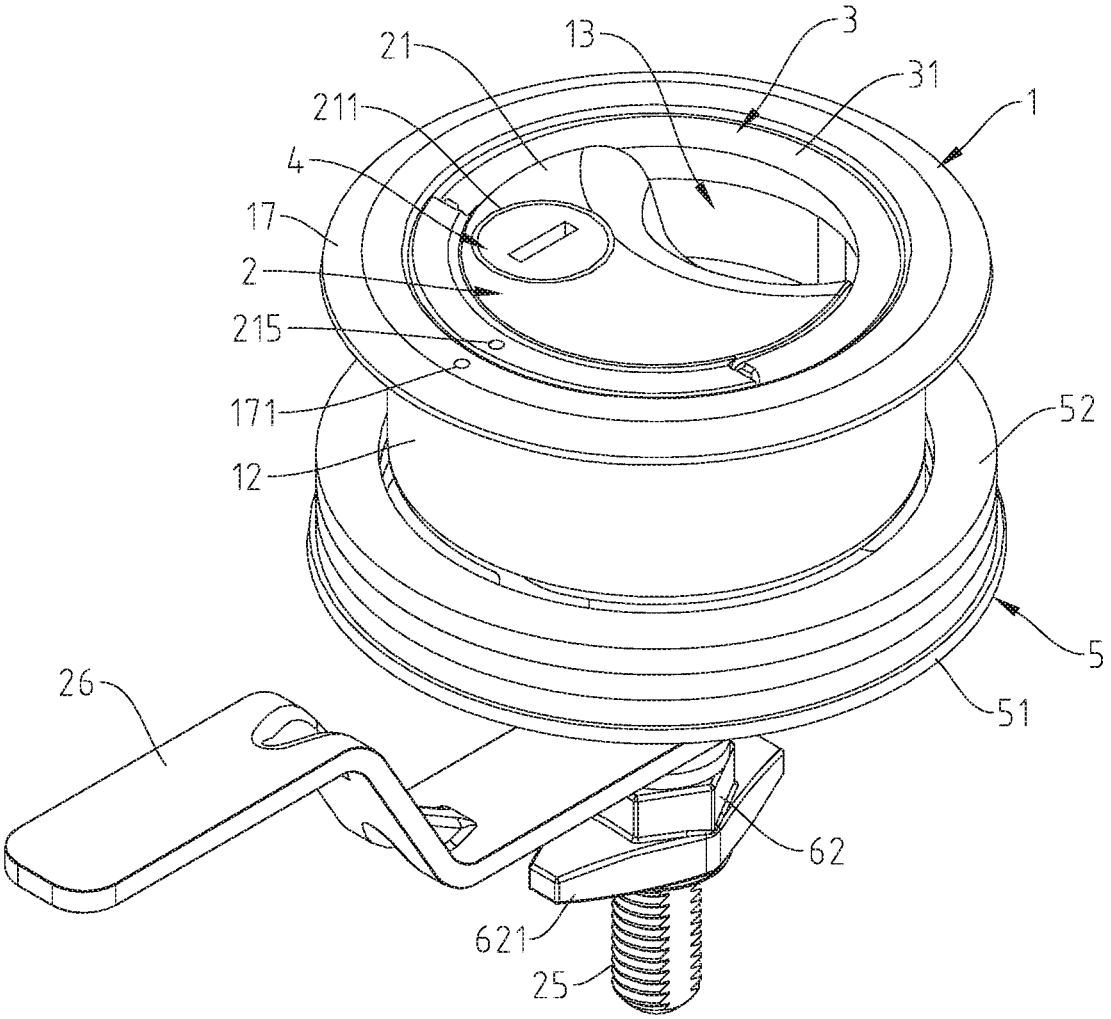
FIG. 1 is a perspective view of a pressing type latch device according to the present invention.
Figure 2:
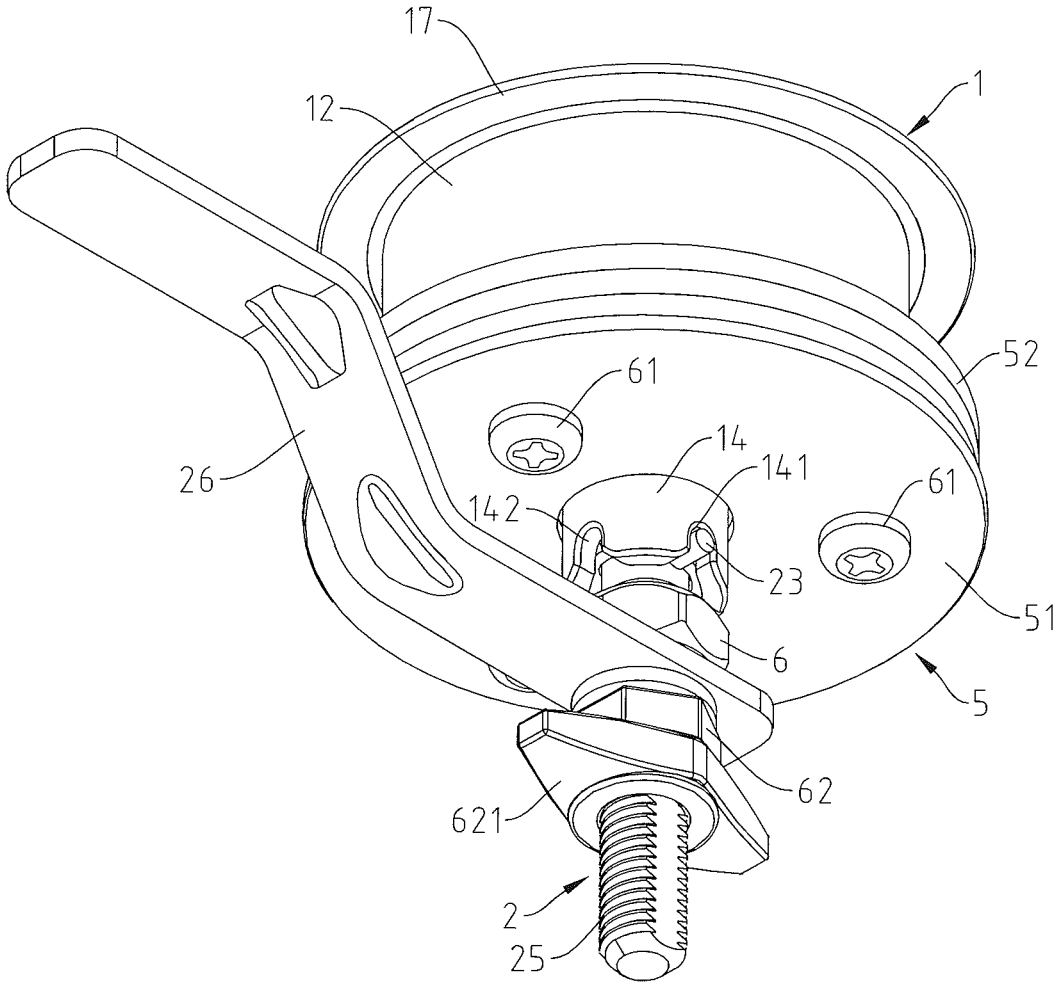
FIG. 2 is another perspective view of the pressing type latch device of FIG. 1.
Figure 3:
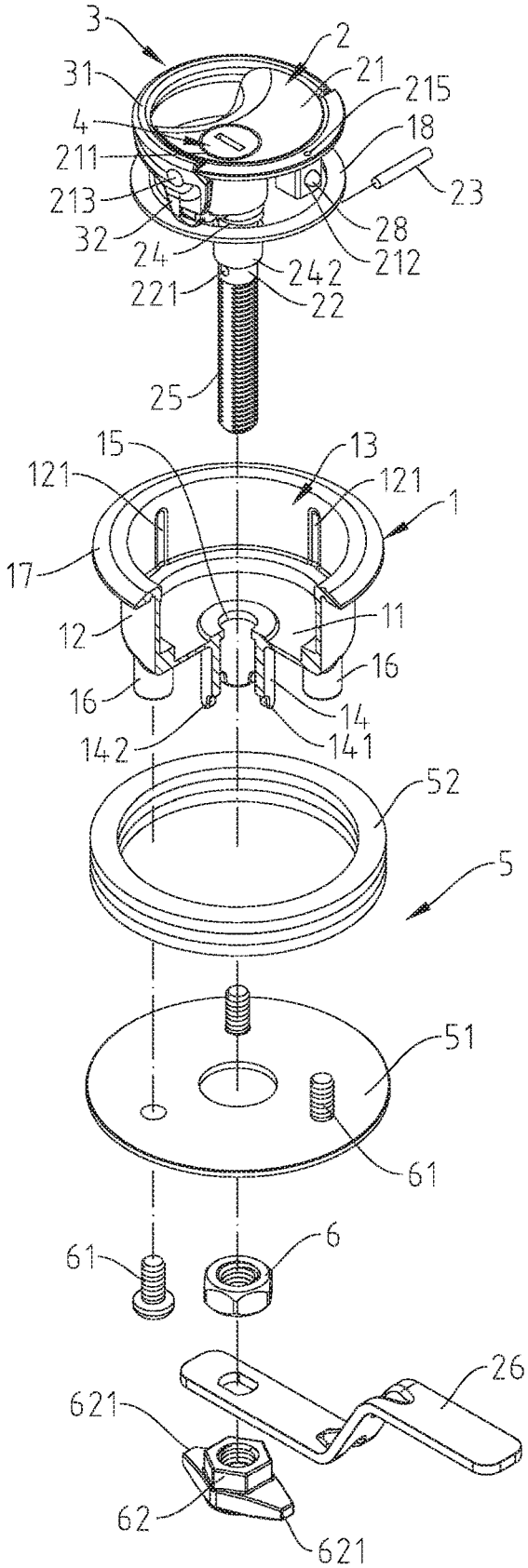
FIG. 3 is an exploded, perspective view of the pressing type latch device of FIG. 1.

With reference to FIGS. 1-4, 6, and 7, a pressing type latch device of an embodiment according to the present invention includes a seat 1, a disc 2, a handle 3, and a fixing unit 5.

The seat 1 includes a base 11. A peripheral wall 12 extends upward from a periphery of the base 11. A distal end of the peripheral wall 12 is bent to form an abutment portion 17. The abutment portion 17 has a first mark 171. A receiving space 13 is defined between the base 11 and the peripheral wall 12 and is circular in cross section. A washer 18 is disposed on a face of the base 11. A restraining portion 14 extends downward from a central portion of a bottom face of the base 11 and has a central hole 15 intercommunicated with the receiving space 13. A plurality of fixing pegs 16 extends downward from the bottom face of the base 11 and surrounds the restraining portion 14. Furthermore, the restraining portion 14 includes a bottom end having two first restraining grooves 141 opposite to each other and two second restraining grooves 142 opposite to each other. The seat 1 includes an inner wall face facing the receiving space 13 and having four engaging grooves 121. The four engaging grooves 121 are spaced from each other by an angle equal to an angle between each of the two first restraining grooves 141 and one of the two second restraining grooves 142.

The disc 2 includes a body 21 received in the receiving space 13 of the seat 1. The disc 2 further includes an actuating portion 22 extending downward from the body 21 along a longitudinal axis and rotatably extending through the central hole 15. The actuating portion 22 has a positioning hole 221 extending in a radial direction. A positioning pin 23 extends through the positioning hole 221 and has two ends exposed outside of the actuating portion 22. The positioning pin 23 is located on the bottom end of the restraining portion 14 of the seat 1. An elastic element 24, two stopper rings 241 and 242, and a leakproof ring 29 are mounted around the actuating portion 22. An upper end of the elastic element 24 abuts the stopper ring 241 and the leakproof ring 29. A lower end of the elastic element 24 abuts the positioning pin 23. The actuating portion 22 is biased downward by the elastic element 24. Furthermore, the disc 2 includes a connecting portion 25 extending downward from the actuating portion 22, and a pressing plate 26 is secured to the connecting portion 25 by a nut 6. Furthermore, a fixing nut 62 is disposed below the pressing plate 26 and is threadedly engaged with the connecting portion 25 of the disc 2. The fixing nut 62 includes two operative ends 621 respectively extending outward from two sides thereof The operative ends 621 can be manually turned to detach the fixing nut 62 and the pressing plate 26, thereby relieving the locking state from inside.

The actuating portion 22 of the disc 2 can rotate 360° about the longitudinal axis and can move along the longitudinal axis. The actuating portion 22 in the rotational range includes a first position 201 (see FIG. 9) corresponding to a retainable closed position of the latch device, a second position 202, a third position 203, and a fourth position 204. Each of the second position 202, the third position 203, and the fourth position 204 corresponds to a retainable open position of the latch device.

Figure 6:
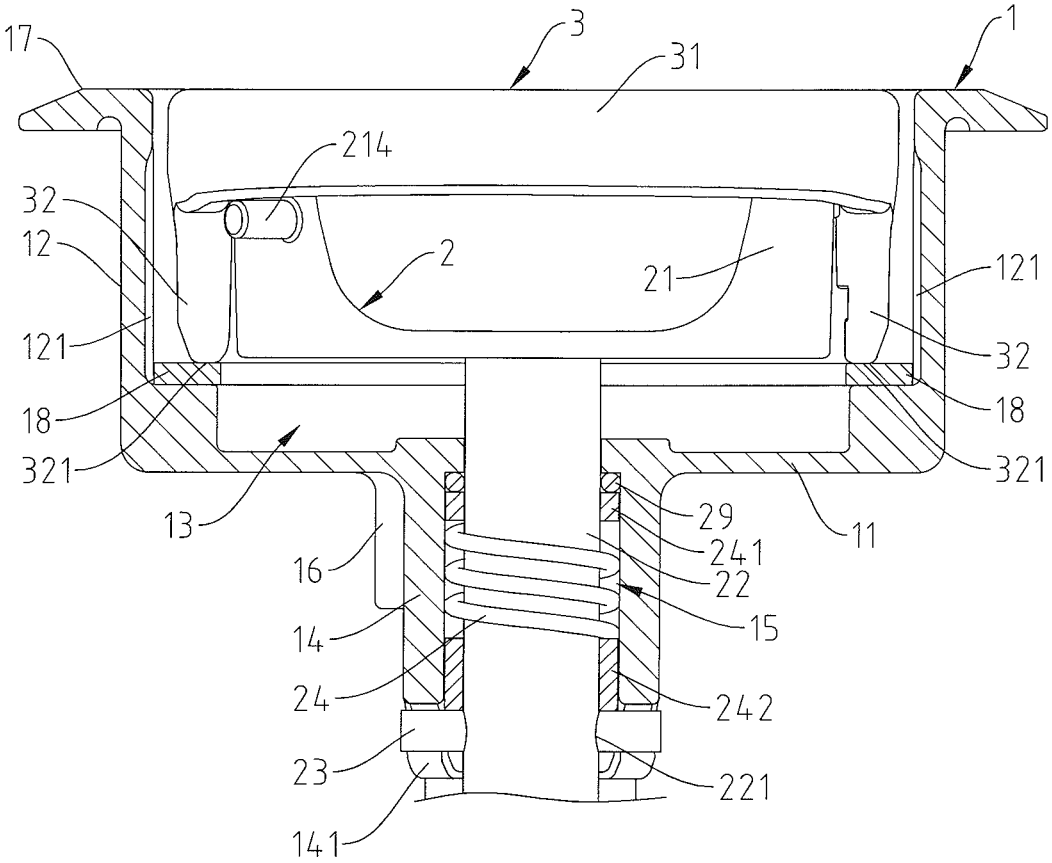
FIG. 6 is a cross sectional view of the pressing type latch device of FIG. 1, with a braking face of the handle abutting against a base.
Figure 7:
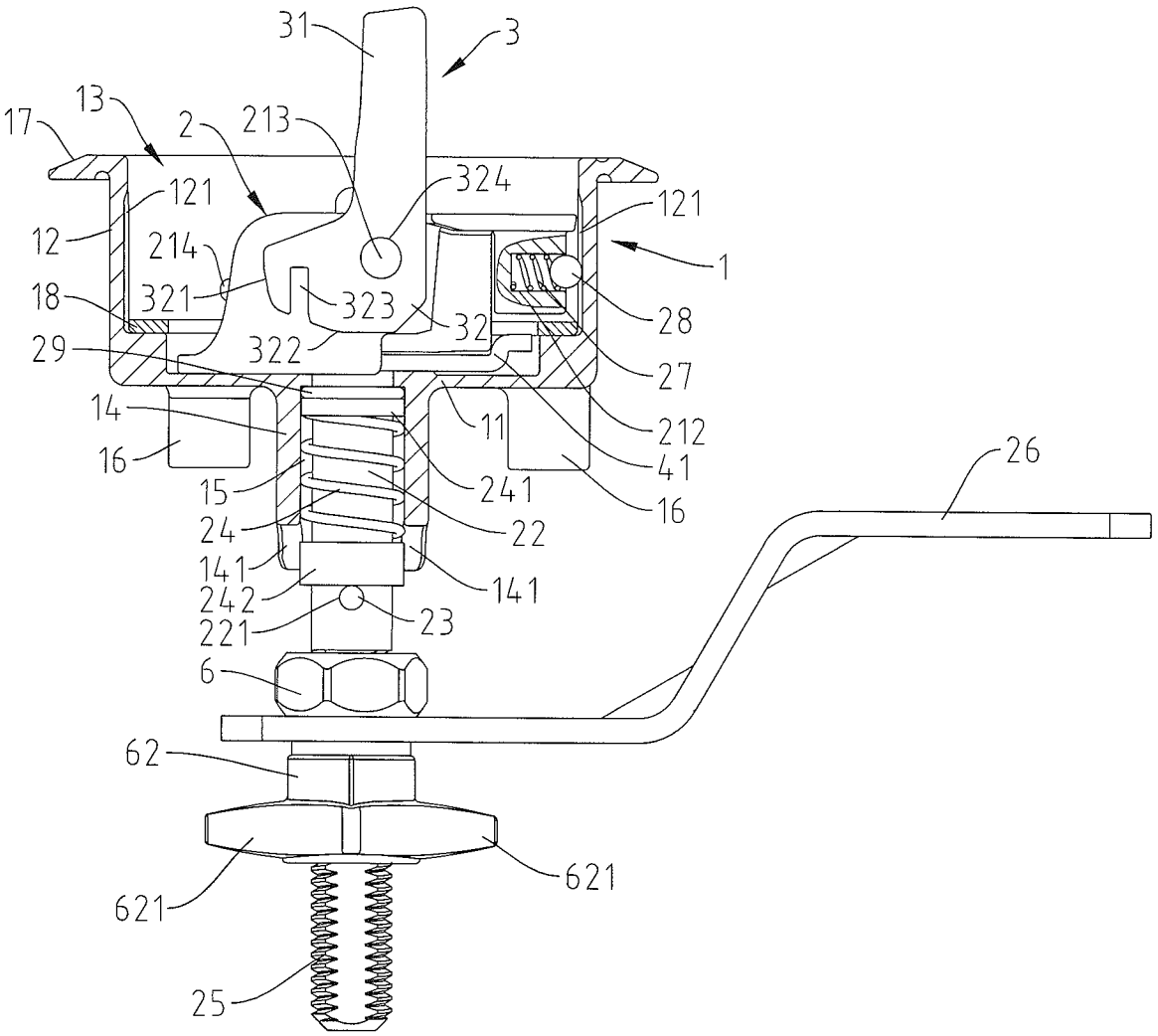
FIG. 7 is a cross sectional view of the pressing type latch device of FIG. 1, with a release face of the handle abutting against the base.

The body 21 of the disc 2 includes a surface having a receiving groove 211 and a second mark 215. A lock 4 is mounted in the receiving groove 211 and includes an engaging member 41 at a lower end thereof. The engaging member 41 is located between the bottom of the body 21 and the base 11. With reference to FIGS. 6 and 7, the body 21 further includes two pivotal pegs 213 and a restraining rod 214 protruding from an outer side thereof and a limiting groove 212 in the outer side thereof. An elastic member 27 and a positioning member 28 are received in the limiting groove 212. The positioning member 28 is partially exposed outside of the limiting groove 212. The positioning member 28 is biased by the elastic member 27 to be engaged in one of the four engaging grooves 121.

The handle 3 includes a grasping portion 31 having two pivotal portions 32 at two ends thereof. The grasping portion 31 can be arcuate or arc-shaped. The two pivotal portions 32 are respectively and pivotably connected to two eccentric locations of two sides of the body 21 of the disc 2, such that a peripheral length of an outer edge of the grasping portion 31 is larger than one half of a circumference of the receiving space 13. In an example, the peripheral length of the outer edge of the grasping portion 31 is 55%-80% of the circumference of the receiving space 13 (such as 60%, 70%, or 75%). In an example, the grasping portion 31 is a portion of a circle in cross section and is shaped corresponding to the receiving space 13. The outer edge of the grasping portion 31 and the outer edge of the body 21 together form a circle. Each of the two pivotal portions 32 includes a side having a braking face 321 and a release face 322. A fixing groove 323 is defined between the braking face 321 and the release face 322. A spacing between the braking face 321 of each of the two pivotal portions 32 and a pivotal connection between the pivotal portion 32 and the body 21 is larger than a spacing between the release face 322 and the pivotal connection between the pivotal portion 32 and the body 21. Furthermore, each of the two pivotal portions 32 has a pivotal hole 324 pivotably receiving one of the two pivotal pegs 213.

The fixing unit 5 includes a fixing board 51 and a gasket 52. The fixing board 51 is fixed by bolts 61 to the plurality of fixing pegs 16 of the seat 1. The gasket 52 is mounted to an outer side of the peripheral wall 12 of the seat 1, such that the latch device is fixed to a door 7 (see FIGS. 9-11).

With reference to FIGS. 1 and 5-9, when the actuating portion 22 of the disc 2 is in one of the first position 201, the second position 202, the third position 203, and the fourth position 204, the grasping portion 31 of the handle 3 is permitted to be received in the receiving space 13 and to lie flush with the body 21. If desired, the grasping portion 31 of the handle 3, the body 21, and the seat 1 can be flush with each other, as shown in FIG. 1. The grasping portion 31 abuts against the restraining rod 214 of the disc 2, and the braking face 321 abuts against the washer 18 on the surface of the base 11. Thus, the two pivotal portions 32 support the body 21 in a position above the base 11, and the positioning pin 23 is located in the two first restraining grooves 141 or the two second restraining grooves 142. In this state, rotational movement of the disc 2 is not permitted. When the actuating portion 22 of the disc 2 is in the first position 201, the second mark 215 is aligned with the first mark 171 to indicate that the latch device is in a positioned state.

Figure 4:
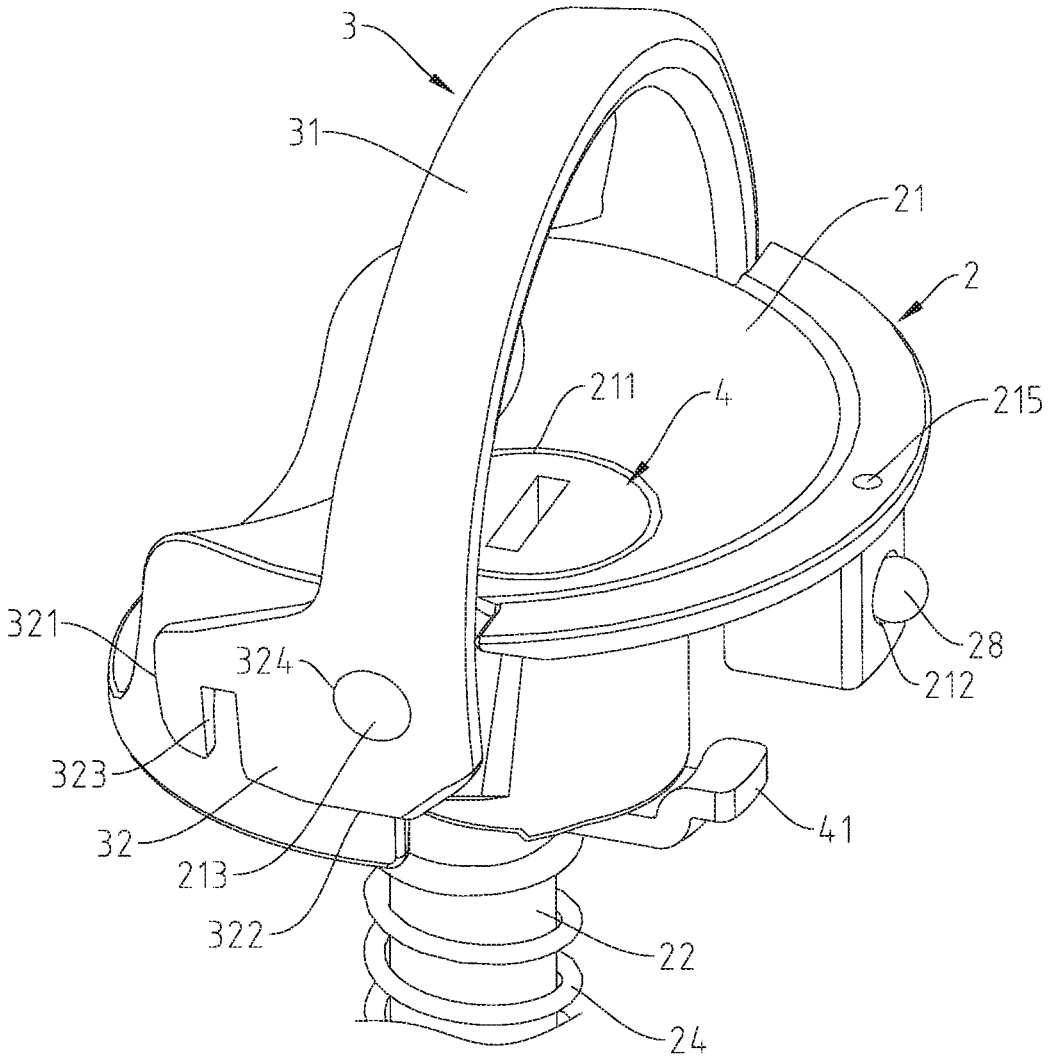
FIG. 4 is a partial, perspective view of the pressing type latch device of FIG. 1.
Figure 8:
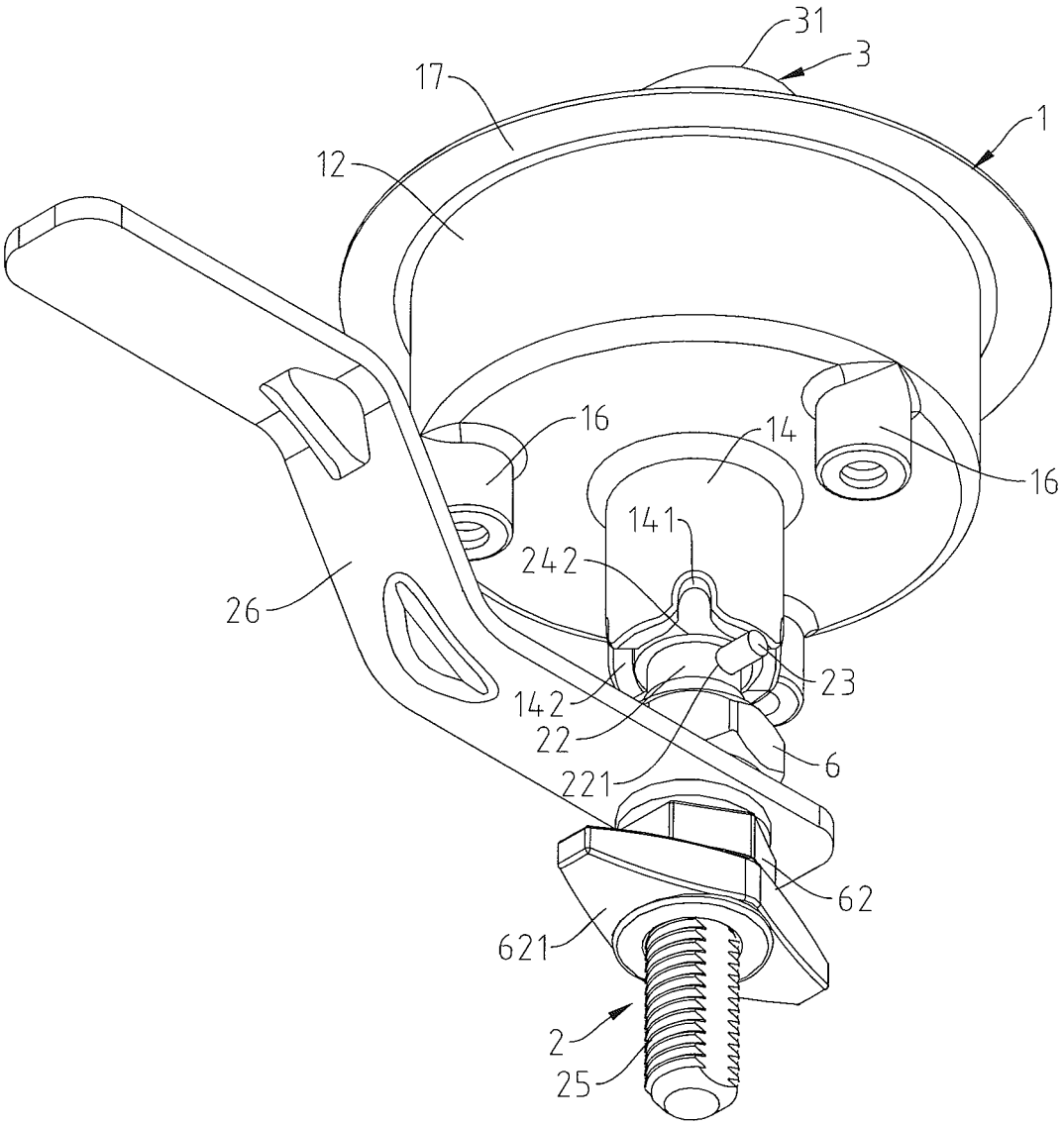
FIG. 8 is a perspective view of the pressing type latch device of FIG. 7.

When the grasping portion 31 is lifted to a position perpendicular to the body 21, the grasping portion 31 can be rotated to rotate the disc 2 via the two pivotal portions 32. With reference to FIGS. 4, 7, and 8, since the two pivotal portions 32 are pivotably connected to two eccentric locations of two sides of the body 21 of the disc 2 to make the peripheral length of an outer edge of the grasping portion 31 be in a range between 50%-80% of the circumference of the receiving space 13, a greater operational height can be formed when the handle 3 is lifted, permitting convenient operation by the fingers of a user. Furthermore, the release face 322 of each pivotal portion 32 abuts against the washer 18 on the surface of the base 11 to make the body 21 adjacent to the base 11, and the positioning pin 23 is moved out of the two first restraining grooves 141 or the two second restraining grooves 142 to a position below the restraining portion 14. In this state, the disc 2 is rotatable.

Figure 5:
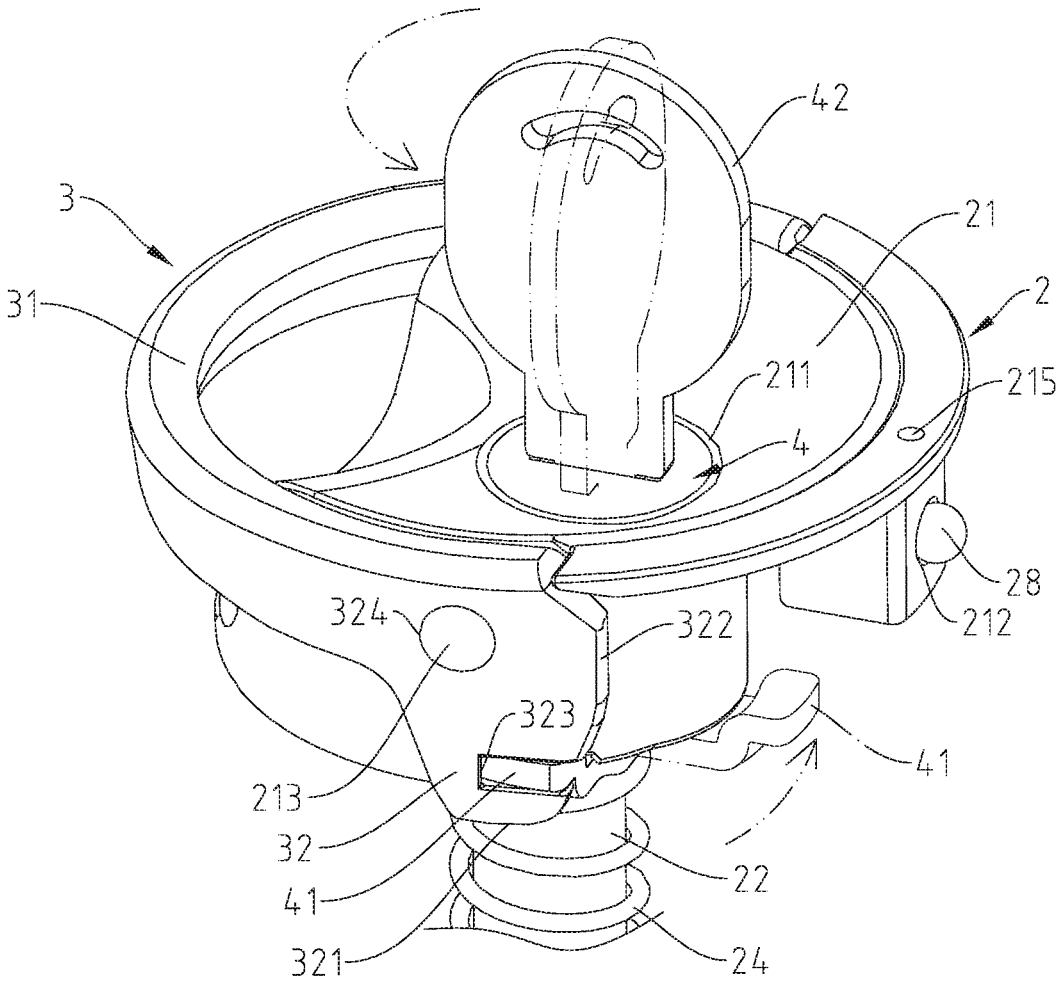
FIG. 5 is a perspective view of the pressing type latch device of FIG. 1, with a handle of the pressing type latch device in a locking position.

With reference to FIG. 5, when the grasping portion 31 of the handle 3 is received in the receiving space 13 and lies flush with the body 21, the braking face 321 abuts against the surface of the base 11 of the seat 1, and each fixing groove 323 faces the engaging member 41. In this case, the user can use a key 42 to rotate the lock 4, moving the engaging member 41 in a direction perpendicular to the longitudinal axis into one of the fixing grooves 323. Thus, the handle 3 is in a state preventing burglars or preventing mistaken opening. Namely, the handle 3 cannot be lifted and rotated.

Figure 9:
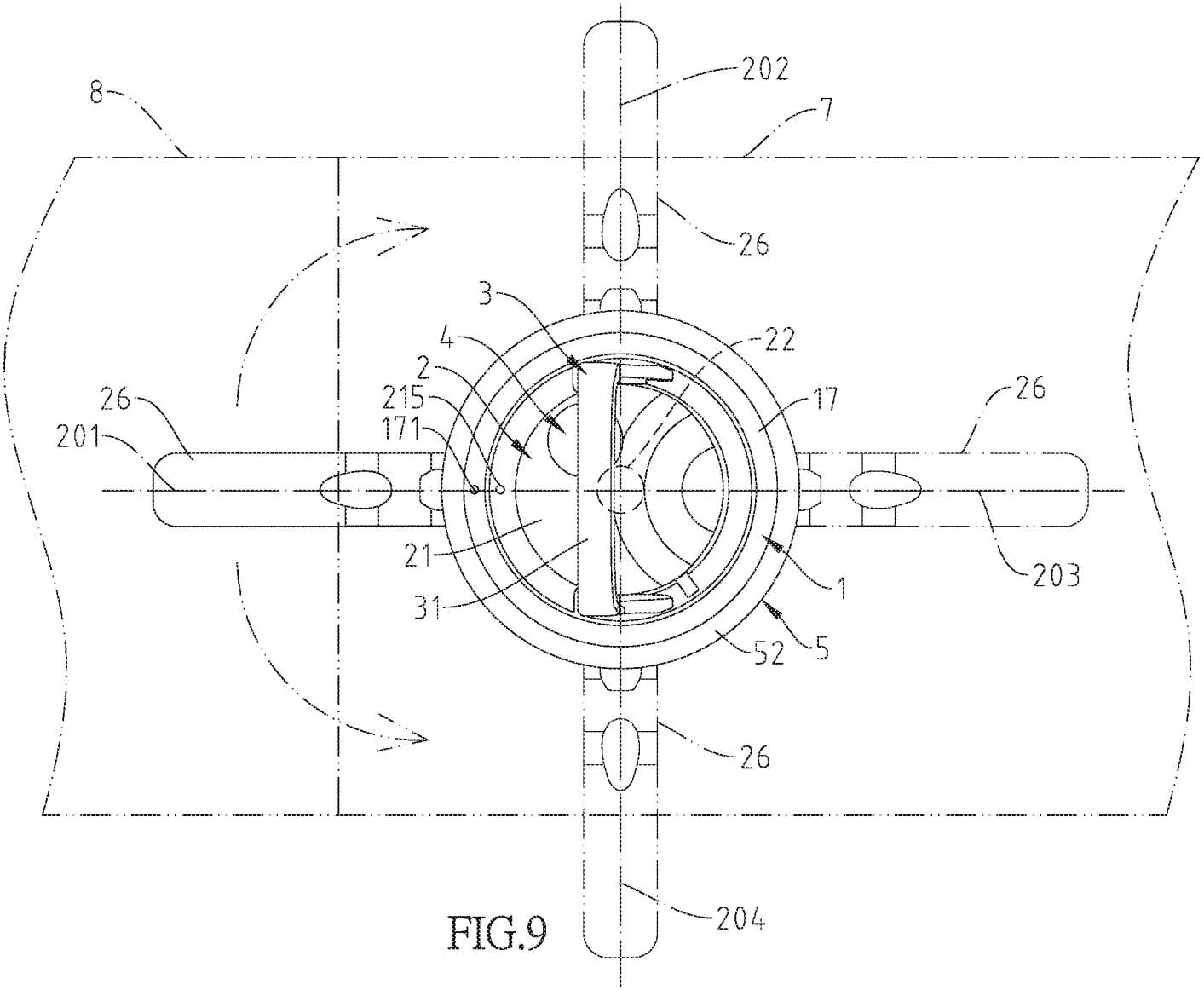
FIG. 9 is a diagrammatic view illustrating use of the pressing type latch device of FIG. 1 on a door.
Figure 10:
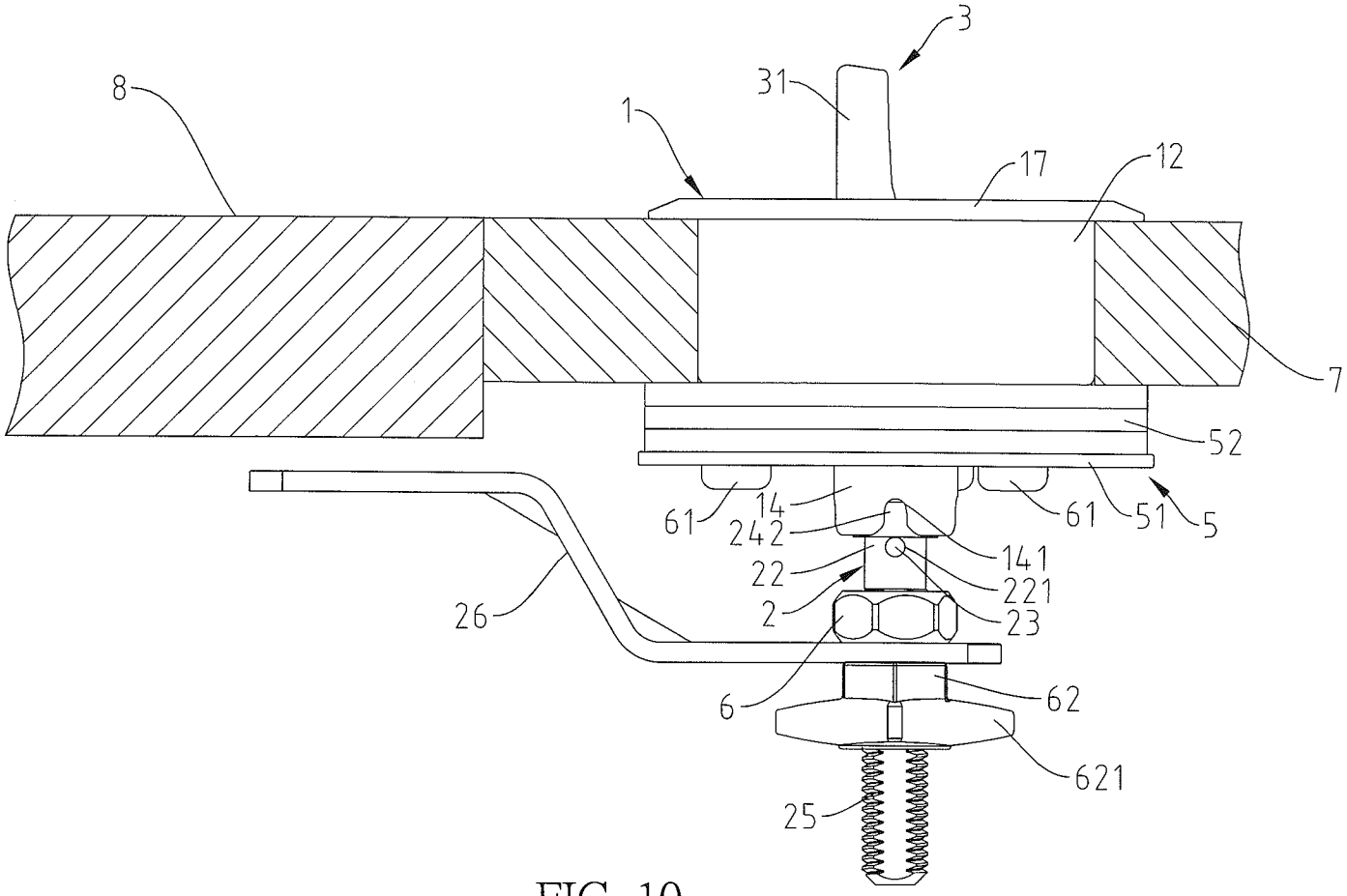
FIG. 10 is a cross sectional view of FIG. 9.
Figure 11:
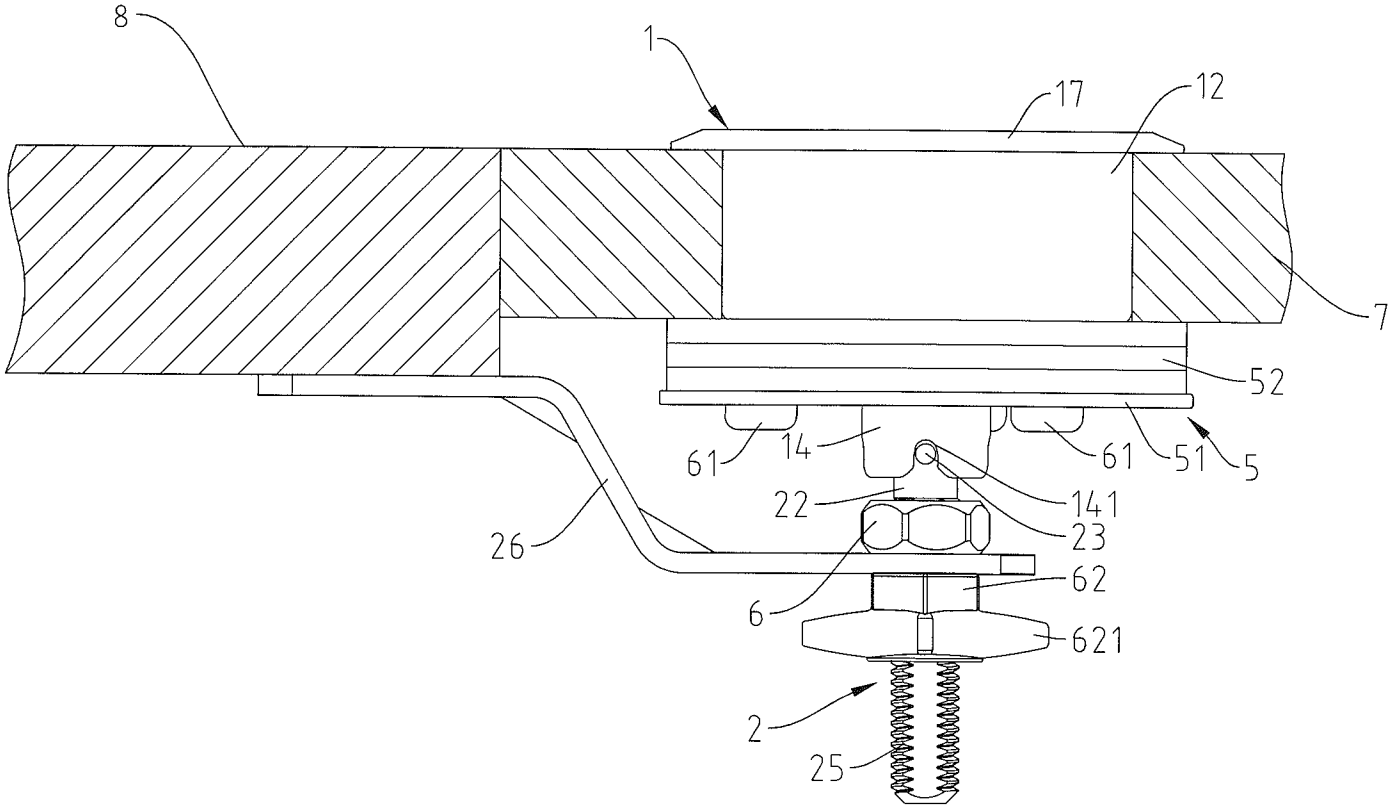
FIG. 11 is a cross sectional view similar to FIG. 10, with a positioning pin positioned in two first restraining grooves.

With reference to FIGS. 6-11, particularly FIGS. 10 and 11, in use of the present invention, the seat 1 is fixed by the fixing unit 5 to the door 7 or a boat hatch. The user rotates the body 21 via the grasping portion 31 of the handle 3, and the body 21 rotates the pressing plate 26 to a position below a door frame 8, reaching the closed position. The elastic member 27 pushes the positioning member 28 to be retained in one of the engaging grooves 121 (FIG. 7). Then, the grasping portion 31 of the handle 3 is moved downward to lie flush with the body 21, such that the two pivotal portions 32 support the body 21 in a position above the base 11, and the positioning pin 23 is located in the two first restraining grooves 141. In this case, the pressing plate 26 abuts against the rear of the door frame 8, pulling the door 7 into the door frame 8 to reach a sealing effect and a positioning effect.

With reference to FIGS. 7 and 9, when it is desired to open the door 7, the user lifts the grasping portion 31 to the position perpendicular to the body 21, and the positioning pin 23 is moved out of the first restraining grooves 141, permitting free rotation of the disc 2. Thus, the user can rotate the disc 2 in either the clockwise direction or the counterclockwise direction to move the pressing plate 26 out of the door frame 8. When the positioning member 28 of the disc 2 is turned to face another engaging groove 121 corresponding to an open position, the elastic element 27 biases the positioning member 28 to be engaged in the corresponding engaging groove 121.

Although specific embodiments have been illustrated and described, numerous modifications and variations are still possible without departing from the scope of the invention. The scope of the invention is limited by the accompanying claims.

The invention claimed is:

1. A latch device comprising:

a seat including a base, with a peripheral wall extending upward from a periphery of the base, with a receiving space defined between the base and the peripheral wall, with a restraining portion extending downward from a central portion of a bottom face of the base and having a central hole intercommunicated with the receiving space;

a disc including a body received in the receiving space of the seat, with the disc further including an actuating portion extending downward from the body along a longitudinal axis and rotatably extending through the central hole, with the actuating portion rotatable about the longitudinal axis within a rotational range, with the actuating portion movable along the longitudinal axis, with the actuating portion in the rotational range including a first position corresponding to a retainable closed position of the latch device and a second position corresponding to a retainable open position of the latch device, with the disc further including a connecting portion extending downward from the actuating portion, and with a pressing plate mounted to the connecting portion; and a handle including a grasping portion having two pivotal portions at two ends thereof, with the grasping portion being arcuate, with the two pivotal portions respectively and pivotably connected to two eccentric locations of two sides of the body of the disc, such that a peripheral length of an outer edge of the grasping portion is larger than one half of a circumference of the receiving space, wherein when the actuating portion of the disc is in the first position or the second position, the grasping portion of the handle is permitted to be received in the receiving space and to lie flush with the body, and the grasping portion is permitted to be lifted to a lifted position relative to the body and to rotate the disc via the two pivotal portions, with the receiving space of the seat being circular in cross section, with the restraining portion including a bottom end having two first restraining grooves opposite to each other and two second restraining grooves opposite to each other, with a positioning pin mounted to the actuating portion of the disc and located on the bottom end of the restraining portion of the seat, with an elastic element mounted around the actuating portion and having two ends respectively abutting a stopper ring in the central hole and the positioning pin, with the grasping portion being a portion of a circle in cross section and shaped corresponding to the receiving space, with each of the two pivotal portions including a side having a braking face and a release face, with a spacing between the braking face of each of the two pivotal portions and a pivotal connection between the pivotal portion and the body being larger than a spacing between the release face and the pivotal connection between the pivotal portion and the body, wherein when the grasping portion lies flush with the body, the braking face abuts against a surface of the base of the seat such that the two pivotal portions support the body in a position above the base, the positioning pin is located in the two first restraining grooves or the two second restraining grooves, and the actuating portion are retainable in third and fourth positions within the rotational range of the actuating portion, wherein each of the third and fourth positions corresponds to a retainable open position of the latch device, and wherein when the grasping portion is lifted to the position perpendicular to the body, the release face of each of the two pivotal portions abuts against the surface of the base to make the body adjacent to the base, and the positioning pin is moved out of the two first restraining grooves or the two second restraining grooves.

2. The latch device as claimed in claim 1, with the body of the disc including a limiting groove in an outer side thereof, with an elastic member and a positioning member received in the limiting groove, with the positioning member partially exposed outside of the limiting groove, with the seat including an inner wall face facing the receiving space and having four engaging grooves, with the four engaging grooves spaced from each other by an angle equal to an angle between each of the two first restraining grooves and one of the two second restraining grooves, and with the positioning member biased by the elastic member to be engaged in one of the four engaging grooves.

3. A latch device comprising:

a seat including a base, with a peripheral wall extending upward from a periphery of the base, with a receiving space defined between the base and the peripheral wall, with a restraining portion extending downward from a central portion of a bottom face of the base and having a central hole intercommunicated with the receiving space;

a disc including a body received in the receiving space of the seat, with the disc further including an actuating portion extending downward from the body along a longitudinal axis and rotatably extending through the central hole, with the actuating portion rotatable about the longitudinal axis within a rotational range, with the actuating portion movable along the longitudinal axis, with the actuating portion in the rotational range including a first position corresponding to a retainable closed position of the latch device and a second position corresponding to a retainable open position of the latch device, with the disc further including a connecting portion extending downward from the actuating portion, and with a pressing plate mounted to the connecting portion; and a handle including a grasping portion having two pivotal portions at two ends thereof, with the grasping portion being arcuate, with the two pivotal portions respectively and pivotably connected to two eccentric locations of two sides of the body of the disc, such that a peripheral length of an outer edge of the grasping portion is larger than one half of a circumference of the receiving space, wherein when the actuating portion of the disc is in the first position or the second position, the grasping portion of the handle is permitted to be received in the receiving space and to lie flush with the body, and the grasping portion is permitted to be lifted to a lifted position relative to the body and to rotate the disc via the two pivotal portions, with the body of the disc including a surface having a receiving groove, with a lock mounted in the receiving groove and including an engaging member at a lower end thereof, with the engaging member located between a bottom of the body and the base, with the engaging member moving perpendicularly to the longitudinal axis when the lock rotates, with at least one of the two pivotal portions of the handle including a fixing groove, and with the fixing groove facing the engaging member when the grasping portion lies flush with the body.

4. The latch device as claimed in claim 3, further comprising a fixing nut located below the pressing plate and threadedly engaged with the connecting portion of the disc, and with the fixing nut including two operative ends respectively extending outward from two sides thereof.

5. The latch device as claimed in claim 3, with a distal end of the peripheral wall of the seat being bent to form an abutment portion, with the abutment portion having a first mark, with the body of the disc including a surface having a second mark, wherein when the latch device is in a positioned state indicated by the second mark when in alignment with the first mark.

6. The latch device as claimed in claim 1, further comprising a fixing nut located below the pressing plate and threadedly engaged with the connecting portion of the disc, and with the fixing nut including two operative ends respectively extending outward from two sides thereof.

7. The latch device as claimed in claim 1, with a distal end of the peripheral wall of the seat being bent to form an abutment portion, with the abutment portion having a first mark, with the body of the disc including a surface having a second mark, wherein when the latch device is in a positioned state indicated by the second mark when in alignment with the first mark.

* * * * *